US010663883B2

(12) United States Patent
Sheng et al.

(10) Patent No.: US 10,663,883 B2
(45) Date of Patent: May 26, 2020

(54) RECHARGEABLE TONER CARTRIDGE, RECHARGEABLE TONER CARTRIDGE ASSEMBLY AND FILTER DEVICE

(71) Applicant: AVISION INC., Hsinchu (TW)

(72) Inventors: Shao-Lan Sheng, Hsinchu (TW); Chuang-Hua Chueh, Hsinchu (TW)

(73) Assignee: Avision Inc., Hsinchu (TW)

( * ) Notice: Subject to any disclaimer, the term of this patent is extended or adjusted under 35 U.S.C. 154(b) by 0 days.

(21) Appl. No.: 16/372,811

(22) Filed: Apr. 2, 2019

(65) Prior Publication Data

US 2019/0332033 A1 Oct. 31, 2019

(30) Foreign Application Priority Data

Apr. 27, 2018 (TW) ..... 107114421 A

(51) Int. Cl.
*G03G 15/08* (2006.01)

(52) U.S. Cl.
CPC ..... *G03G 15/0867* (2013.01); *G03G 15/0889* (2013.01); *G03G 15/0894* (2013.01)

(58) Field of Classification Search
CPC ..... G03G 15/0867; G03G 15/0886; G03G 15/0889; G03G 15/0894; G03G 2215/00987
See application file for complete search history.

(56) References Cited

U.S. PATENT DOCUMENTS

| | | | | |
|---|---|---|---|---|
| 8,818,245 | B2 * | 8/2014 | Takaya | G03G 15/0844 399/257 |
| 2009/0016777 | A1 * | 1/2009 | Miyamoto | G03G 15/0874 399/238 |
| 2011/0229209 | A1 | 9/2011 | Takaya et al. | |
| 2013/0055685 | A1 * | 3/2013 | Itabashi | G03G 15/0879 53/467 |
| 2016/0023460 | A1 | 1/2016 | Lin | |

(Continued)

FOREIGN PATENT DOCUMENTS

| | | | |
|---|---|---|---|
| CN | 201955624 U | | 8/2011 |
| CN | 107175918 A | | 9/2017 |
| JP | 2000242068 A | * | 9/2000 |

OTHER PUBLICATIONS

Machine translation of JP 2000-242068 A (publishication date of Sep. 8, 2000) printed on Sep. 20, 2019.*

(Continued)

*Primary Examiner* — Sophia S Chen
(74) *Attorney, Agent, or Firm* — Muncy, Geissler, Olds & Lowe, P.C.

(57) ABSTRACT

A rechargeable toner cartridge assembly includes a toner cartridge, a toner refilling bottle and a filter device. The toner cartridge includes a toner refilling hole and a connection portion, both of which are disposed on one end of the toner cartridge and penetrate through a housing of the toner cartridge. The toner refilling bottle contains toner, which is refilled into the toner cartridge through the toner refilling hole. The filter device connected to the connection portion filters the toner off a mixed gas overflowing from the toner cartridge to discharge clean air, wherein the toner cartridge and the filter device are two independent devices. The filter device and a rechargeable toner cartridge without a built-in inner air filter element are also provided.

16 Claims, 11 Drawing Sheets

(56) References Cited

U.S. PATENT DOCUMENTS

2016/0299455 A1* 10/2016 Tsuritani ..... G03G 15/0889
2017/0136774 A1 5/2017 Lin

OTHER PUBLICATIONS

Chang,Hung-Chih; Liu,Tsung-Cheng, "Principle and Repair of Copier", http://img.duxiu.com/n/print.jsp, English translation attached, Published Jun. 1977, pp. 99-102.

* cited by examiner

RECHARGEABLE TONER CARTRIDGE, RECHARGEABLE TONER CARTRIDGE ASSEMBLY AND FILTER DEVICE

CROSS-REFERENCE TO RELATED APPLICATIONS

This application claims priority of No. 107114421 filed in Taiwan R.O.C. on Apr. 27, 2018 under 35 USC 119, the entire content of which is hereby incorporated by reference.

BACKGROUND OF THE INVENTION

Field of the Invention

This disclosure relates to a rechargeable toner cartridge, a filter device and a rechargeable toner cartridge assembly, and more particularly to a toner cartridge, into which toner can be refilled, a filter device matching and being used with the toner cartridge upon toner refilling, and a rechargeable toner cartridge assembly of the rechargeable toner cartridge, the filter device and a toner refilling bottle.

Description of the Related Art

Peripherals, such as printers and copiers are indispensable apparatuses in offices. Such a peripheral has a printing module, which applies an image forming agent, such as toner or ink, to a medium (e.g., a sheet), and the image forming agent is then fixed to the medium by way of hot pressing. Compared with the peripheral body, the toner is a consumptive article and needs to be replaced or refilled at regular timings. For the sake of convenient service, the manufacturer generally provides the disposable toner cartridge, and the old toner cartridge whose toner is used up is directly replaced with a new toner cartridge. However, the toner cartridge containing the toner is further provided with a toner guiding device and an anti-leakage device for preventing the flowing toner from leakage. So, the direct replacement of the new toner cartridge has the high cost, and is not advantageous to environment protection.

Recently, a toner a refill hole is provided on the toner cartridge in order to decrease the cost. When the user is refilling the toner, the air together with the refilled toner enter the toner cartridge and then overflow from the refill hole, and the overflowing air and toner are spread into the atmosphere. Such the design is not environment protective, and also wastes the toner. When the user accidentally breathes the toner in the atmosphere, health problems in his/her respiratory system are caused.

In the prior art, the toner cartridge configured to have the built-in filtering element has the following drawbacks. First, the filtering element is exposed to the environment containing the toner for a long time, so the problem of the blockage of the filtering element tends to occur. Second, because the filtering element is built in the rechargeable toner cartridge, it is not practical to clean or replace the filtering element when the blockage of the filtering element occurs so that the function of the filtering element fails.

BRIEF SUMMARY OF THE INVENTION

In summary, an object of this disclosure is to provide a toner cartridge, which can be connected to a filter device to facilitate the user in refilling toner and prevent the toner from overflowing from the filter device with air, so that the effects of environment protection, convenience and safety can be obtained.

To achieve the above-identified object, this disclosure provides a rechargeable toner cartridge without an inner air filter passage. In other words, the toner cartridge of this disclosure does not have the air filtering function. The rechargeable toner cartridge of this disclosure includes: a toner refilling hole being an opening used to refill toner; and a connection portion, wherein the connection portion and the toner refilling hole are disposed on one end of the toner cartridge, and penetrate through a housing of the toner cartridge. In the rechargeable toner cartridge, an air flow path from the toner refilling hole to the connection portion is a direct path without passing through an air filter element.

The above-mentioned air filter element mainly functions to filter the toner off the air, so that no toner leaves the toner cartridge together with the air, no air pollution occurs, and the user's health cannot be affected.

Furthermore, the connection portion is to be connected to a filter device for filtering the toner off the air overflowing from toner cartridge upon toner filling, so that the overflowing toner is separated from the air and left in the filter device.

To achieve the above-identified object, this disclosure further provides a filter device collocating with or used in conjunction with the toner cartridge. The filter device includes a body, a chamber, an intake hole, an outtake hole and multiple baffle plates. The chamber is a space having a fixed volume in the body of the filter device. The intake hole is disposed on the body, is connected to a first connection portion of a toner cartridge and communicates with the chamber. The outtake hole is disposed on one end or one side of the body corresponding to the intake hole and communicates with the chamber and the intake hole. The baffle plates are staggered and disposed in the chamber, so that the air entering the chamber from the intake hole cannot reach the outtake hole until the air flows through a serpentine outtake path formed by the multiple baffle plates. When the air enters the intake hole of the filter device from the first connection portion of the toner cartridge, the air needs to pass through the non-linear path formed by the baffle plates in the chamber before being discharged from the outtake hole.

To achieve the above-identified object, this disclosure further provides a rechargeable toner cartridge assembly including a toner cartridge, a toner refilling bottle and a filter device. The toner cartridge includes a toner refilling hole and a connection portion. Both of the toner refilling hole and the connection portion are disposed on one end of the toner cartridge, and penetrate through the housing of the toner cartridge. The filter device connected to the connection portion filters toner off a mixed gas overflowing from the toner cartridge and discharges clean air. The filter device may include a body, a chamber, an intake hole, an outtake hole and multiple baffle plates. The chamber is a space with a fixed volume in the body of the filter device. The toner refilling bottle contains the toner. The toner is refilled into the toner cartridge through the toner refilling hole. The intake hole disposed on the body and connected to the connection portion of the toner cartridge communicates with the chamber. The outtake hole is disposed on one end or one side of the body corresponding to the intake hole, and communicates with the chamber and the intake hole. The baffle plates are staggered and disposed in the chamber, so that the air entering the chamber from the intake hole cannot reach the outtake hole after flowing through a serpentine outtake path formed by the baffle plates. When the air enters the intake hole of the filter device from the first connection portion of the toner cartridge, the air needs to pass through a non-linear path formed by the baffle plates in the chamber before being discharged from the outtake hole.

Furthermore, this disclosure further provides a rechargeable toner cartridge assembly including a toner cartridge, a toner refilling bottle and a filter device. The toner cartridge includes a toner refilling hole and a connection portion. Both of the toner refilling hole and the connection portion are disposed on one end of the toner cartridge and penetrate through the housing of the toner cartridge. The toner refilling bottle contains toner. The toner is refilled into the toner cartridge through the toner refilling hole. The filter device filters the toner off a mixed gas overflowing from the toner cartridge, and includes a body, a chamber and an intake hole. The body is flexible and made of a material, such as rubber, a balloon, a plastic bag or the like. The chamber is a space with a non-fixed volume in the body of the filter device. In other words, the chamber is a space with a retractable volume. The intake hole disposed on the body is connected to the connection portion of the toner cartridge and can communicate with the chamber. The mixed gas coming from the connection portion enters the chamber through the intake hole. When the mixed gas enters the intake hole of the filter device from the connection portion of the toner cartridge, the mixed gas with the toner overflowing from the connection portion enters the chamber. The overflowing mixed gas is produced when the user is refilling the toner because the mouth of the toner refilling bottle is fit with the toner refilling hole of the toner cartridge. When the toner is filled into the toner cartridge, the mixed gas in the toner cartridge firstly flows to the connection portion. After the toner refilling bottle recovers the original shape, the air in the toner cartridge and the filter device further returns to the toner refilling bottle, and the retractable volume space of the filter device further returns to the original state. Thus, when the toner is being refilled, the toner cannot be dispersed into the atmosphere due to the overflowing air, and there is no adverse effect provided to the air pollution and the user's health.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

If an element capable of facilitating the flowing of gas or mixed air is additionally provided outside the toner refilling hole, then the overflowing air can be discharged from this element when the toner is being refilled, and the old toner and the new toner refilled into the toner cartridge cannot overflow from the toner refilling hole. In addition, the newly provided element for the toner cartridge also needs the device for filtering the mixed air (the mixture of air and toner) to separate the toner from the air, so that the overflowing air cannot cause injure to the health of the human body. In this disclosure, the toner is preferably dry toner presented in the form of powder.

If the filtering element or filtering passage is disposed inside the toner cartridge and the toner blocks the filtering element or filtering passage, then the overall toner cartridge cannot be used any more. Thus, the filtering element of this disclosure is disposed outside the toner cartridge to overcome the above-mentioned problem.

Figure 1A:
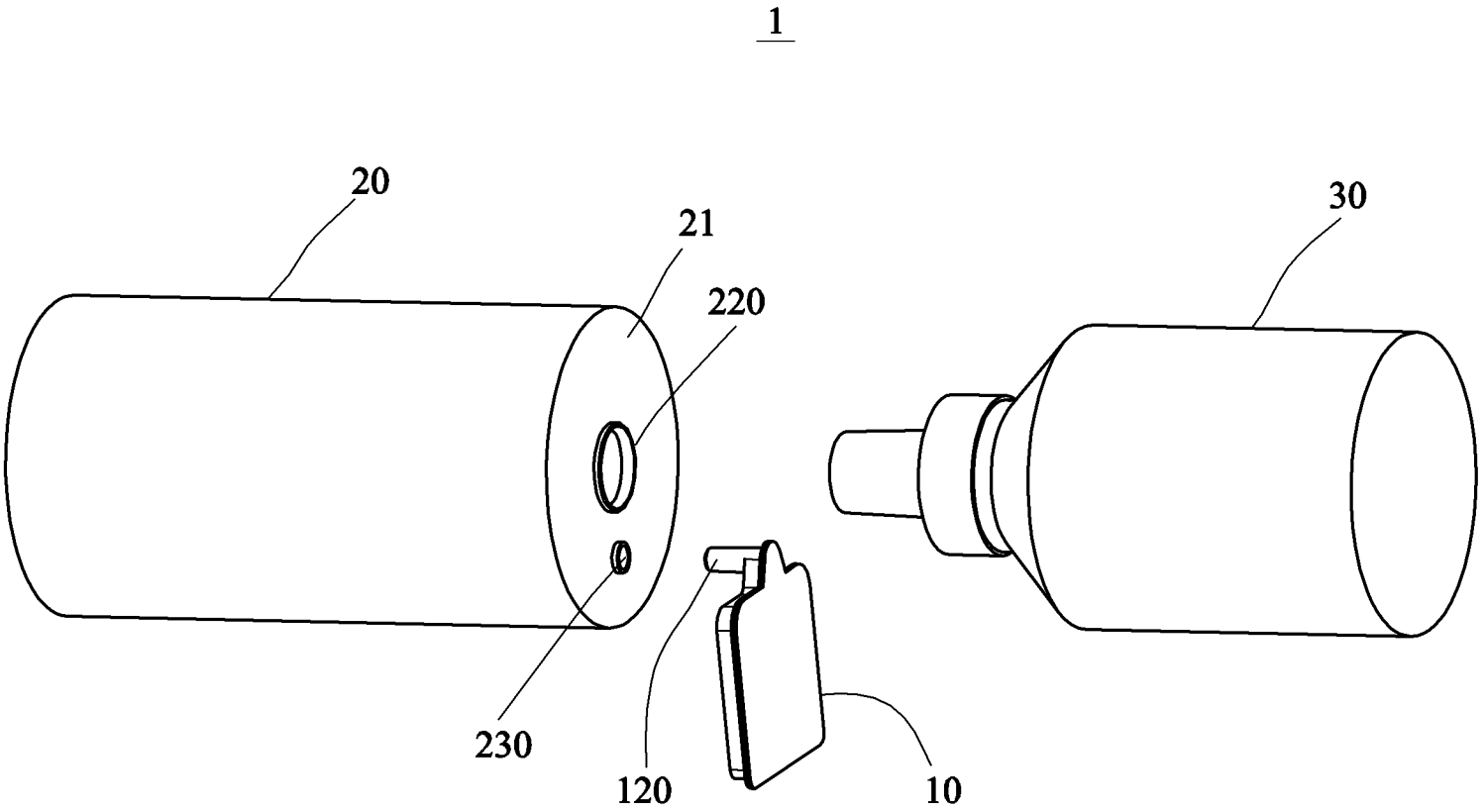
FIGS. 1A and 1B are assembled and exploded views showing a rechargeable toner cartridge assembly of this disclosure.
Figure 1B:
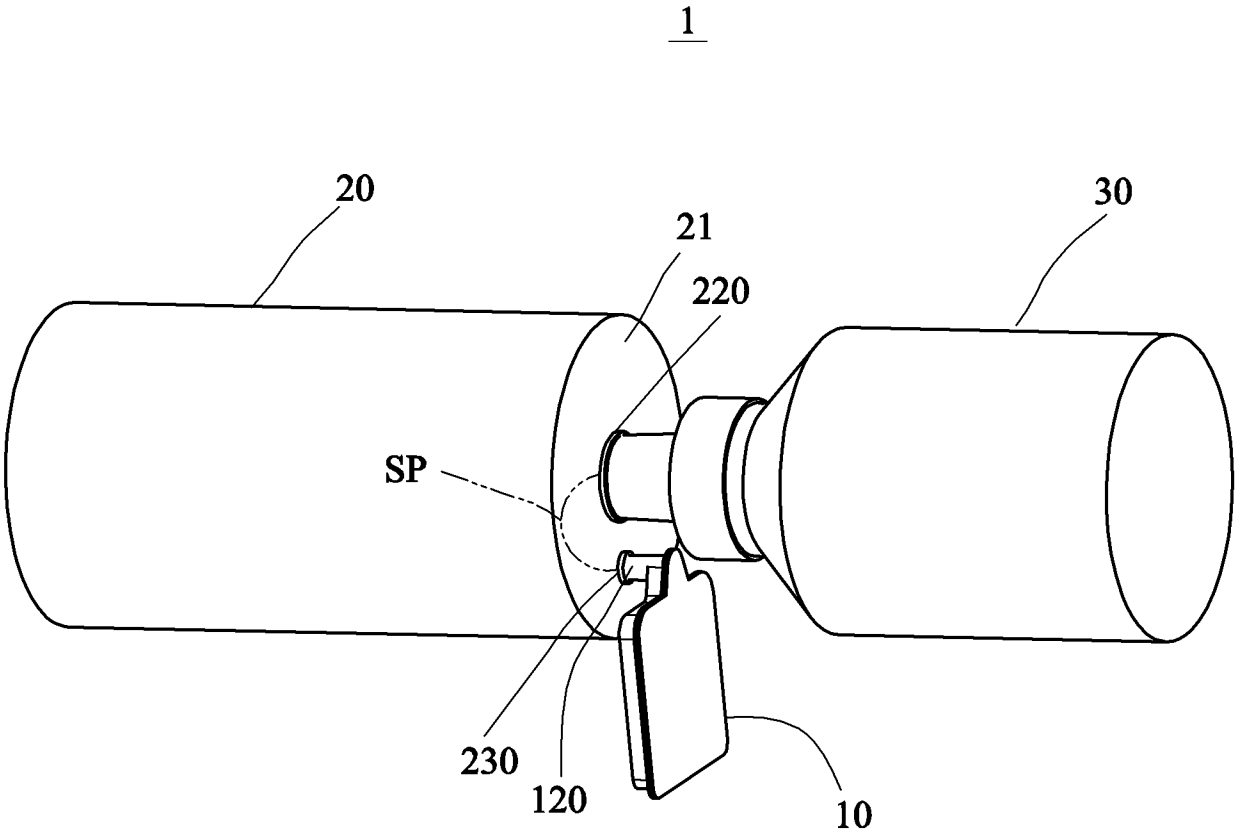
Figure 1C:
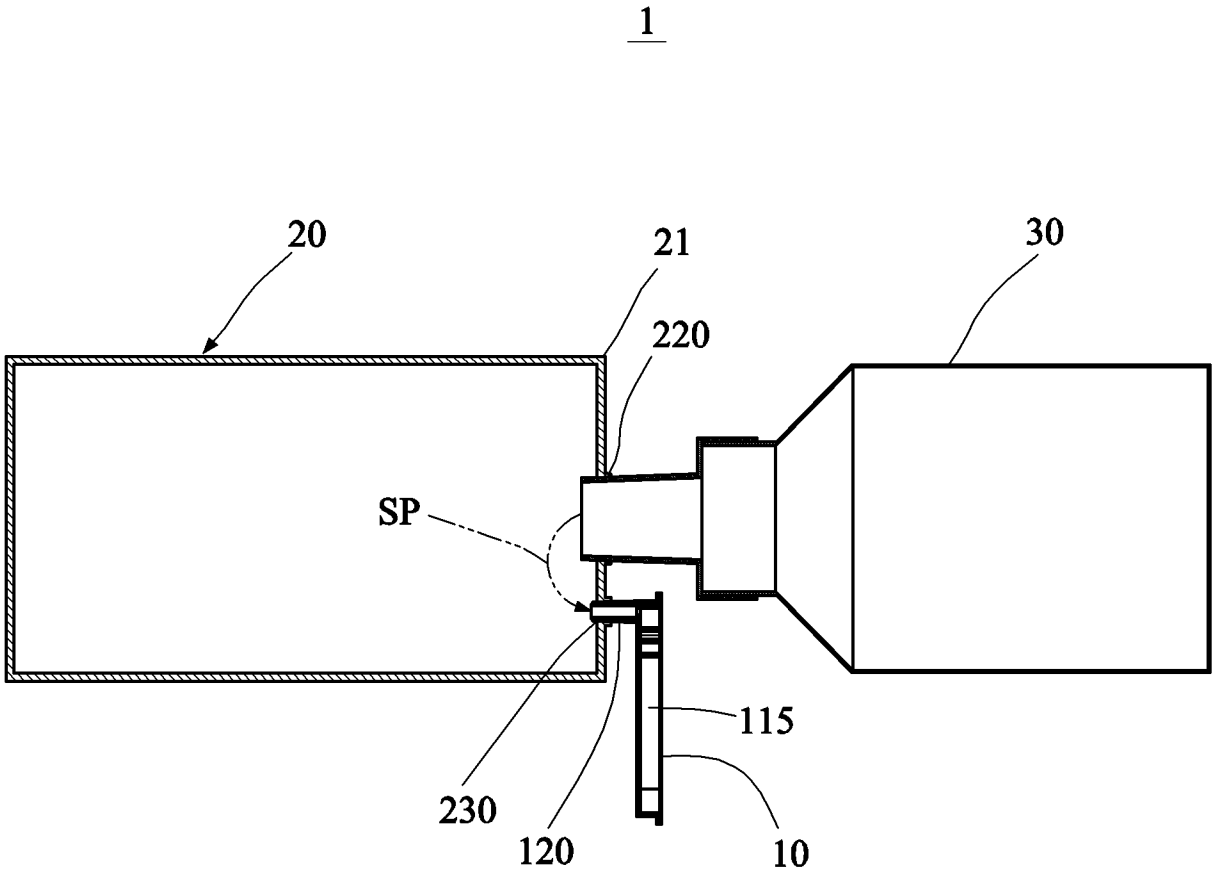
FIG. 1C is a cross-sectional view showing the rechargeable toner cartridge assembly of this disclosure.
Figure 2A:
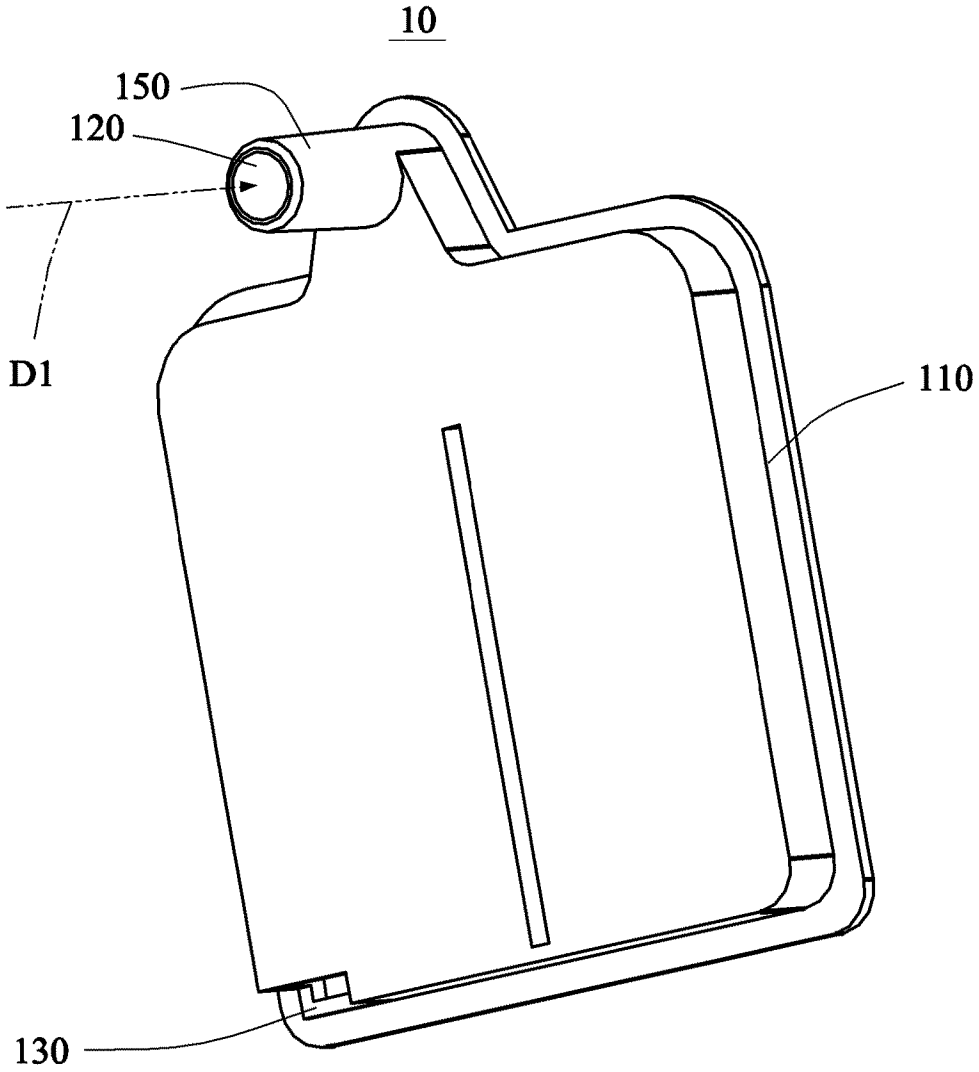
FIG. 2A is a pictorial view showing a filter device according to this disclosure.
Figure 2B:
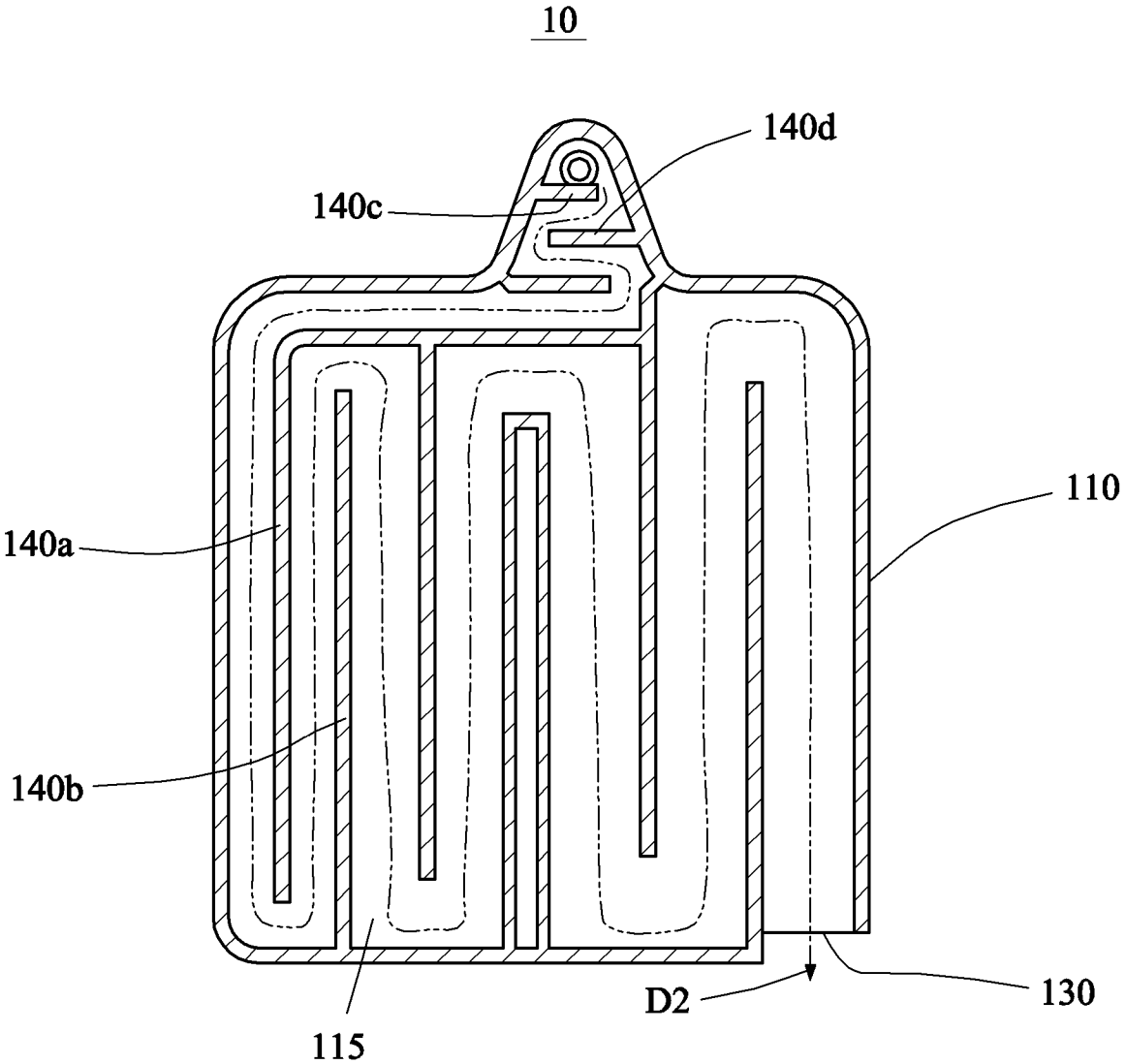
FIG. 2B is a cross-sectional view showing the filter device according to this disclosure.
Figure 2C:
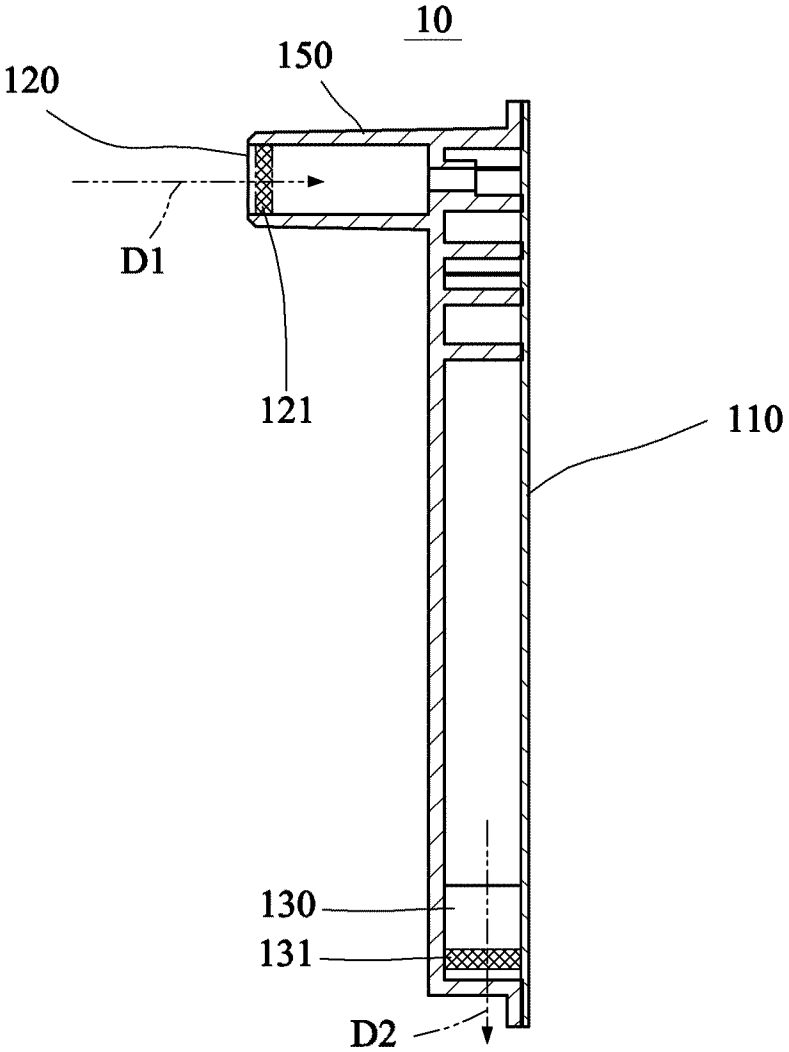
FIG. 2C is a right-side view showing the filter device according to this disclosure.

To achieve the above-identified object, this disclosure provides a rechargeable toner cartridge 20 without built-in air filter element or passage. In other words, the toner cartridge 20 of this disclosure does not have the air filtering function. FIGS. 1A and 1B are assembled and exploded views showing a rechargeable toner cartridge assembly 1 of this disclosure. FIG. 1C is a cross-sectional view showing the rechargeable toner cartridge assembly 1 of this disclosure. FIGS. 2A to 2C are respectively a pictorial view, a cross-sectional view and a right-side view showing the filter device according to this disclosure. Referring to FIGS. 1A to 2C, the toner cartridge 20 of this disclosure includes a toner refilling hole 220 and a first connection portion 230. The toner refilling hole 220 is an opening used when the user is filling the toner (dry toner). Both of the first connection portion 230 and the toner refilling hole 220 are disposed on one end of the toner cartridge 20, and penetrate through a housing 21 of the toner cartridge 20. No air filter element communicating with the first connection portion 230 is provided in the toner cartridge 20. In other words, an air flow path SP inside the toner cartridge 20 and from the toner refilling hole 220 to the first connection portion 230 is a direct path without passing through an air filter element. The so-called air flow path SP includes the air flow path bypassing an element, such as a stirrer (to be explained later), but does not include a filtering passage (e.g., a baffle and a serpentine and curved passage defined by the housing 21), or a filtering element (e.g., a toner filter containing a sponge or a net), which is dedicated for the toner filtering. In this embodiment, the direct path represents that the mixed gas of the toner and air cannot pass through the filtering element (including the passage) capable of separating the toner from the air after the user squeezes the toner refilling bottle 30 to refill the toner, and is directly outputted from the first connection portion 230 and directly filtered by a filter device 10. In detail, both of the first connection portion 230 and the toner refilling hole 220 are disposed on one end of the toner cartridge 20, may be disposed on the same surface of the toner cartridge 20 or two adjacent side surfaces (not shown), but are not individually disposed on two opposite surfaces. In this embodiment, the first connection portion 230 is an opening formed on the surface of the housing 21. In another embodiment, however, the first connection portion may be an opening of a projecting tube formed on the surface of the housing.

Furthermore, the toner cartridge 20 further includes a first cover (not shown) for covering the toner refilling hole 220, and a second cover (not shown) for covering the first connection portion 230. When the toner cartridge 20 is normally used, the toner refilling hole 220 and the first connection portion 230 are respectively covered by the first cover and the second cover. At this time, the toner refilling hole 220 and the first connection portion 230 provide no function. When the user wants to refill the toner, the first cover and the second cover are removed, so that the toner can be refilled through the toner refilling hole 220, and the first connection portion 230 has the connection function with the filter device 10. The first cover and the second cover may have various aspects, may be detachable or pivotal, may also be provided separately, or may be integrally formed and linked with each other, and detailed descriptions thereof will be omitted.

The first connection portion 230 may further include a buffer pad (not shown) disposed on the junction, so that the first connection portion 230 and the filter device 10 can be connected together in a tighter manner.

This disclosure further provides the rechargeable toner cartridge assembly 1. When the user wants to refill the toner from the toner refilling bottle 30 into the toner cartridge 20, the user connects the filter device 10 to the toner cartridge 20 to filter the toner off the mixed air (or referred to as the mixed gas, which is a mixture of air and toner) overflowing from the toner cartridge 20. The rechargeable toner cartridge assembly 1 includes a toner cartridge 20, a toner refilling bottle 30 and a filter device 10. Referring to FIGS. 1A to 1C, the toner cartridge 20 includes a toner refilling hole 220 and a first connection portion 230. Both of the toner refilling hole 220 and the first connection portion 230 are disposed on one end of the toner cartridge 20, and penetrate through the housing 21 of the toner cartridge 20. The toner refilling bottle 30 contains the toner, and the toner refilling bottle 30 refills the toner into the toner cartridge 20 through the toner refilling hole 220. The filter device 10 includes a body 110, a chamber 115, an intake hole 120, an outtake hole 130 (FIG. 2A) and multiple baffle plates 140*a* to 140*d* (FIG. 2B). The chamber is a space with a fixed volume in the body 110 of the filter device 10. The intake hole 120 is disposed on the body 110 and connected to the first connection portion 230 of the toner cartridge 20, and communicates with the chamber. The outtake hole 130 is disposed on one end or one side of the body 110 corresponding to the intake hole 120, and the outtake hole 130, the chamber and the intake hole 120 communicate with one another, so that the mixed gas entering the chamber 115 from the intake hole 120 can be filtered and then overflow from the outtake hole 130. The baffle plates 140*a* to 140*d* penetrate through the chamber, or are disposed in the chamber and staggered, so that the air (or mixed gas) entering the chamber 115 from the intake hole 120 cannot reach the outtake hole 130 until flowing through a serpentine outtake path D2 formed by the baffle plates 140*a* to 140*d*. When the air enters the intake hole 120 of the filter device 10 from the first connection portion 230 of the toner cartridge 20, the air needs to pass through the non-linear serpentine outtake path D2 formed by the baffle plates 140*a* to 140*d* in the chamber, and is then discharged from the outtake hole 130.

It is to be further explained that the toner cartridge 20 and the filter device 10 in the rechargeable toner cartridge assembly 1 of this disclosure are two independent devices. When the user wants to refill the toner into the toner cartridge 20, the user needs to connect the filter device 10 to the toner cartridge 20. In addition, because the toner precipitates due to the gravity, the toner refilling hole 220 and the first connection portion 230 in the rechargeable toner cartridge assembly 1 of this disclosure are disposed on one end of the toner cartridge. In another embodiment, the toner refilling hole 220 and the first connection portion 230 are disposed on adjacent side surfaces of the toner cartridge. It is worth noting that the toner refilling hole 220 and the first connection portion 230 cannot be disposed on the corresponding side surfaces, such as the top surface and the bottom surface; or otherwise the first connection portion 230 of the toner cartridge 20 may be blocked by the toner.

Furthermore, this disclosure further provides a filter device 10 collocating with and being used with the toner cartridge 20 having the first connection portion 230 to filter the toner off the air overflowing from the toner cartridge 20. FIG. 2A is a pictorial view showing a filter device according to this disclosure. FIG. 2B is a cross-sectional view showing the filter device according to this disclosure. FIG. 2C is a right-side view showing the filter device according to this disclosure. Referring to FIGS. 2A to 2C, the filter device 10 of this disclosure includes a body 110, a chamber 115 in the body 110, an intake hole 120, an outtake hole 130 and multiple baffle plates 140*a* to 140*d*. The chamber is a space with a fixed volume in the body 110 of the filter device 10. The intake hole 120 is disposed on the body 110 and to be connected to the first connection portion 230 of the toner cartridge 20, and communicates with the chamber. The air overflowing from the toner cartridge 20 into the filter device 10 enters the filter device 10 in the air intake direction D1 at the junction between the intake hole 120 and the first connection portion 230. The outtake hole 130 is disposed on one end or one side of the body 110 corresponding to the intake hole 120. The outtake hole 130, the chamber and the intake hole 120 communicate with one another. The baffle plates 140*a* to 140*d* are staggered and disposed in the chamber, so that the air enters from the intake hole 120 cannot reach the outtake hole 130 and overflow until flowing through the serpentine outtake path D2 formed by the baffle plates 140*a* to 140*d*. When the air enters the intake hole 120 of the filter device 10 from the first connection portion 230 of the toner cartridge 20, the air cannot be discharged from the outtake hole until flowing through the non-linear path formed by the baffle plates 140*a* to 140*d* disposed in the chamber.

The above-mentioned multiple baffle plates 140*a* to 140*d* may be arranged in a vertically staggered manner (e.g., the baffle plates 140*a* and 140*b*) and in a horizontally staggered manner (e.g., the baffle plates 140*c* and 140*d*), and the air flowing directions can be designed according to the positions and orientations of the intake hole 120 and the outtake hole 130 on the filter device 10. In this embodiment, the arranged orientations and positions of the baffle plates 140*a* to 140*d* are not particularly restricted, and the serpentine path of the air-hole passage mainly achieves the effect of filtering the toner. Furthermore, the orientations of the intake hole 120 and the outtake hole 130 may be parallel with or perpendicular to each other, and the orientations and positions of the intake hole 120 and the outtake hole 130 are not restricted in this embodiment.

Furthermore, a filter 121 for filtering the toner in the toner cartridge is further disposed at the intake hole 120, so that the toner filtering becomes more complete, and the overflowing air becomes cleaner. In addition, a filter 131 for filtering the toner in the chamber 115 may be further disposed at the outtake hole 130, and the discharged gas becomes cleaner.

It is to be further explained that the filter device 10 of this disclosure mainly functions to filter the toner off the overflowing air, but is not restricted to the aspect of the serpentine passage formed by the baffle plates 140*a* to 140*d*, and another filtering device with the similar function may also be adopted to achieve this effect. The filtering device may be, for example, a conduit and one single-layer of layer or multiple layers of filters disposed in the passage of the conduit; a container having an inlet and an outlet and one single-layer or multiple layers of filters disposed in the chamber of the container; or the like, wherein the filter device is connected to the first connection portion 230, filters off the toner off the mixed gas overflowing from the toner cartridge 20, and then discharges the clean air.

The toner cartridge 20 of this disclosure needs to be used in conjunction with the filter device 10 having the filtering function. If the toner cartridge 20 has no first connection portion 230 connected to the filter device 10, then the user only can refill the toner into the toner cartridge 20 by way of pouring. At this time, the toner directly overflows from the toner refilling hole 220 together with the air, so that the user encounters the mental pressure and the influence of the body health upon refilling the toner. So, the toner cartridge 20 and the filter device 10 of this disclosure are indispensable and need to be used together.

Furthermore, the outer edge of a second connection portion 150 of the filter device 10 may further include a buffer pad (not shown). When the filter device 10 and the first connection portion 230 are connected together, this buffer pad can achieve the seamless connection effect. In this embodiment, the second connection portion 150 is an opening of a projecting tube and is connected and collocated with the first connection portion 230. In another embodiment, however, the second connection portion may be an opening formed on the surface of the body 110, and is collocated and connected with the first connection portion in the form of the opening of the projecting tube.

If the filter device 10 is directly and integrally disposed inside the toner cartridge 20, then the filtering element inside the toner cartridge 20 inevitably incurred the additional material and cost. In practice, for multiple toner cartridges 20, each toner cartridge 20 has its own filtering element, which cannot be shared, and the resource is wasted. So, when the filter device 10 is independently provided, it can be used in conjunction with different toner cartridges 20 to further achieve the environment protection effect.

In addition, the filter device 10 in this embodiment further includes a second connection portion 150, which is disposed at the intake hole 120 of the body 110, and snaps to or docks with the first connection portion of the toner cartridge 20. The second connection portion 150 and the body 110 may be integrally formed.

This disclosure further provides a rechargeable toner cartridge assembly 1'. When the user wants to refill the toner from the toner refilling bottle 30 to the toner cartridge 20, the user connects the filter device 10' to the toner cartridge 20 to filter the toner off the air overflowing from the toner cartridge 20. The rechargeable toner cartridge assembly 1' includes a toner cartridge 20, a toner refilling bottle 30 and a filter device 10'.

Figure 3A:
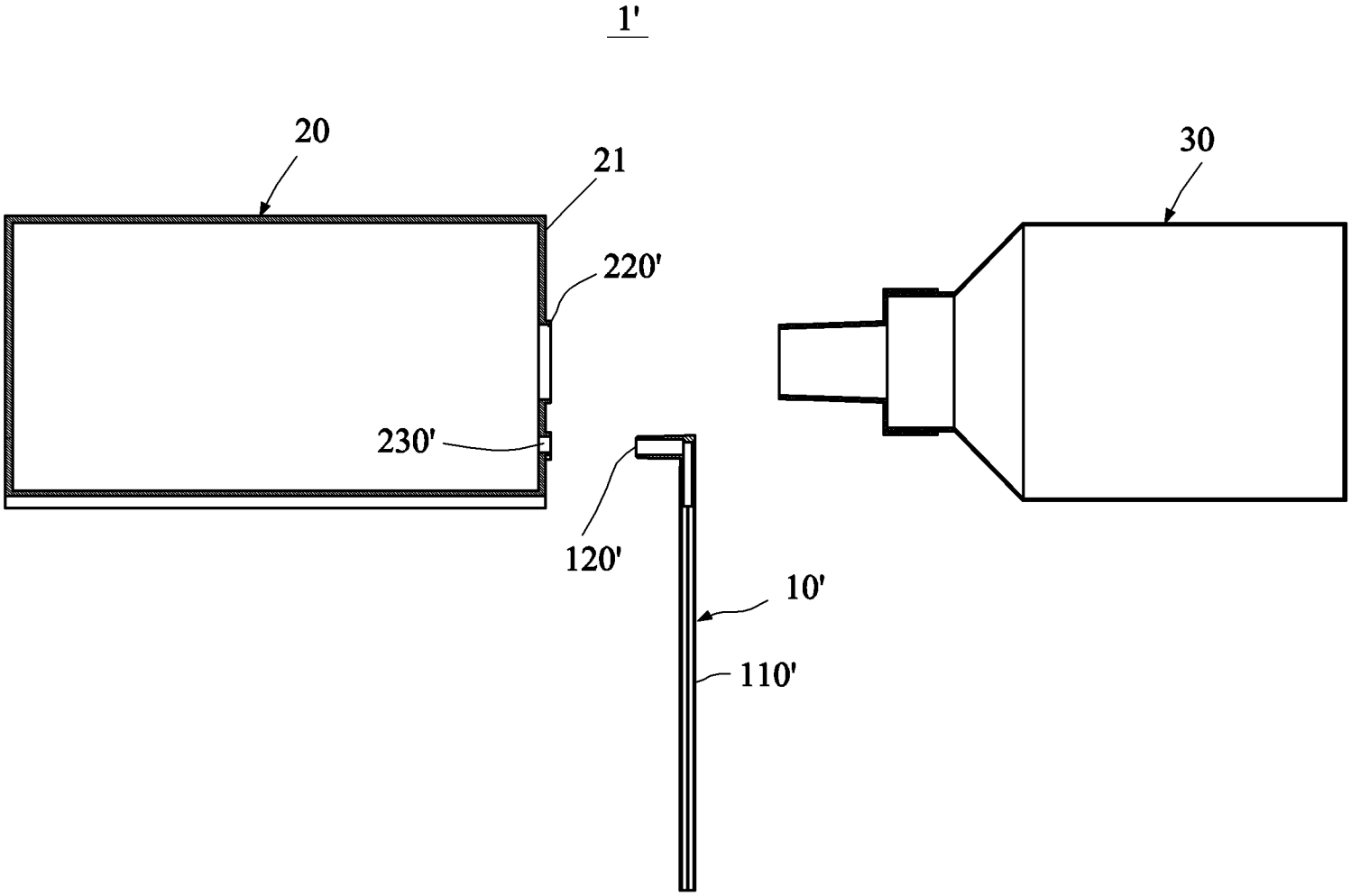
FIG. 3A is a schematic exploded view showing a rechargeable toner cartridge assembly before being used according to another embodiment of this disclosure.
Figure 3B:
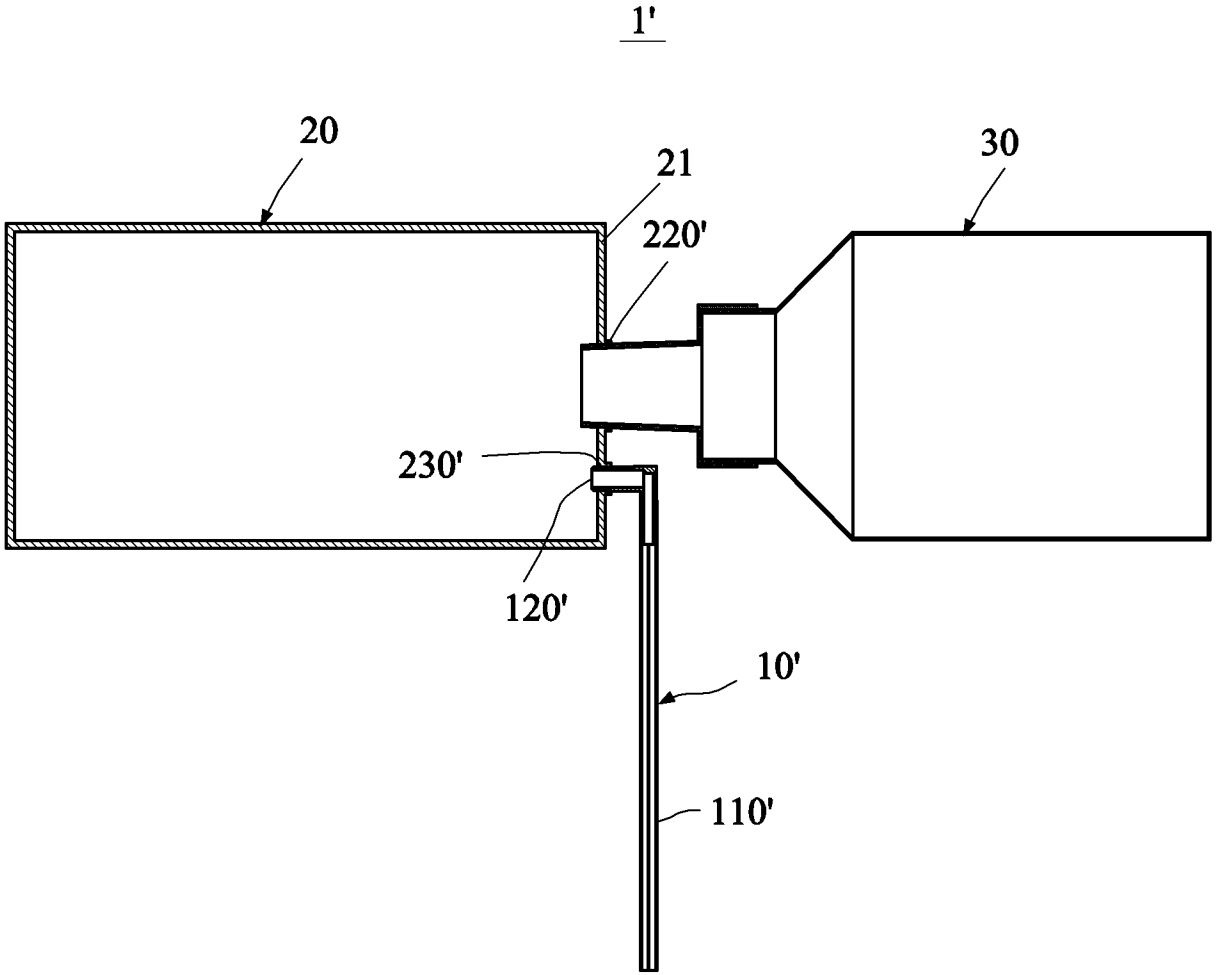
FIG. 3B is an assembled cross-sectional view showing the rechargeable toner cartridge assembly upon being used according to another embodiment of this disclosure.
Figure 3C:
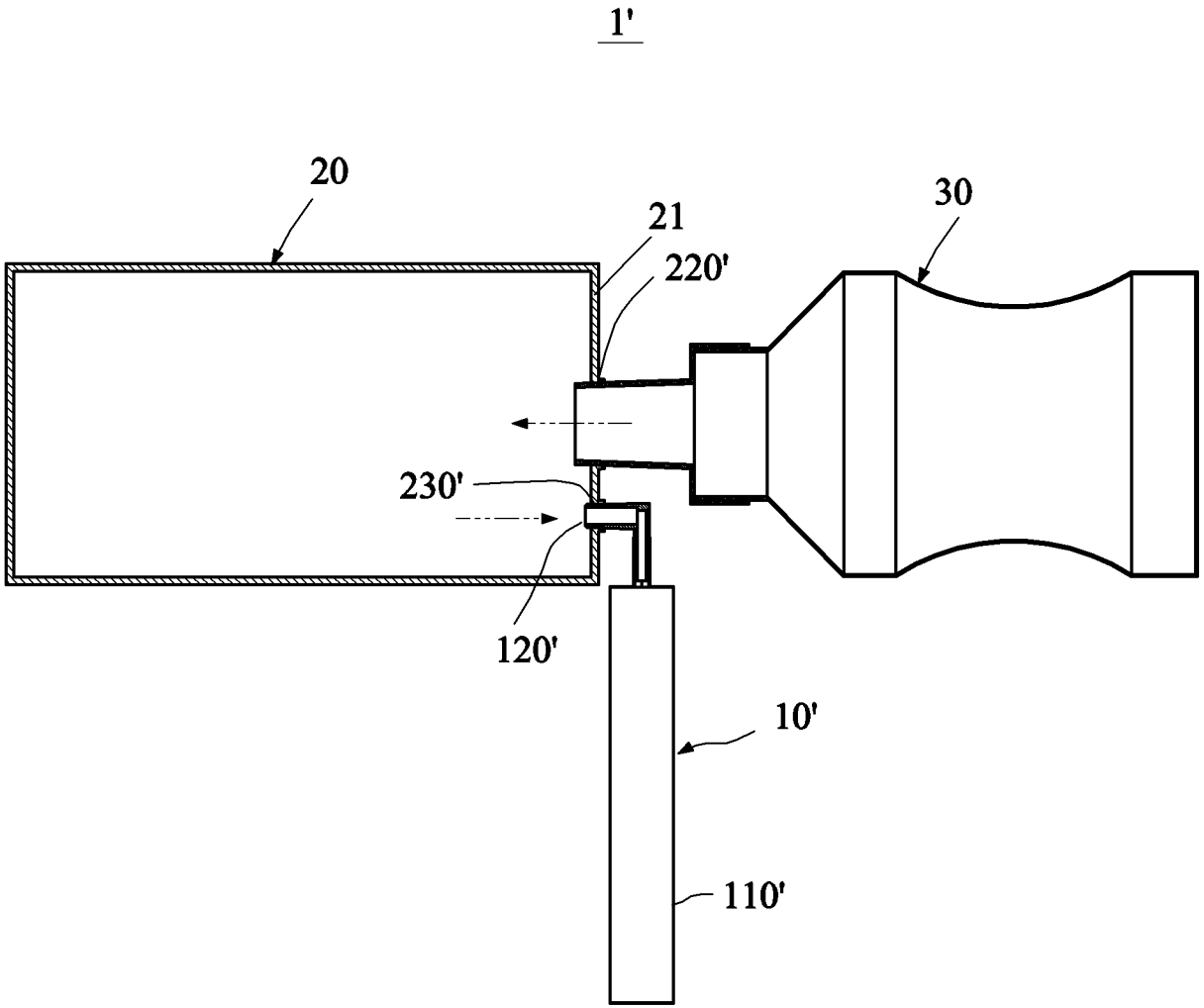
FIG. 3C is a schematic view showing air flow directions in the rechargeable toner cartridge assembly upon being used according to another embodiment of this disclosure.
Figure 3D:
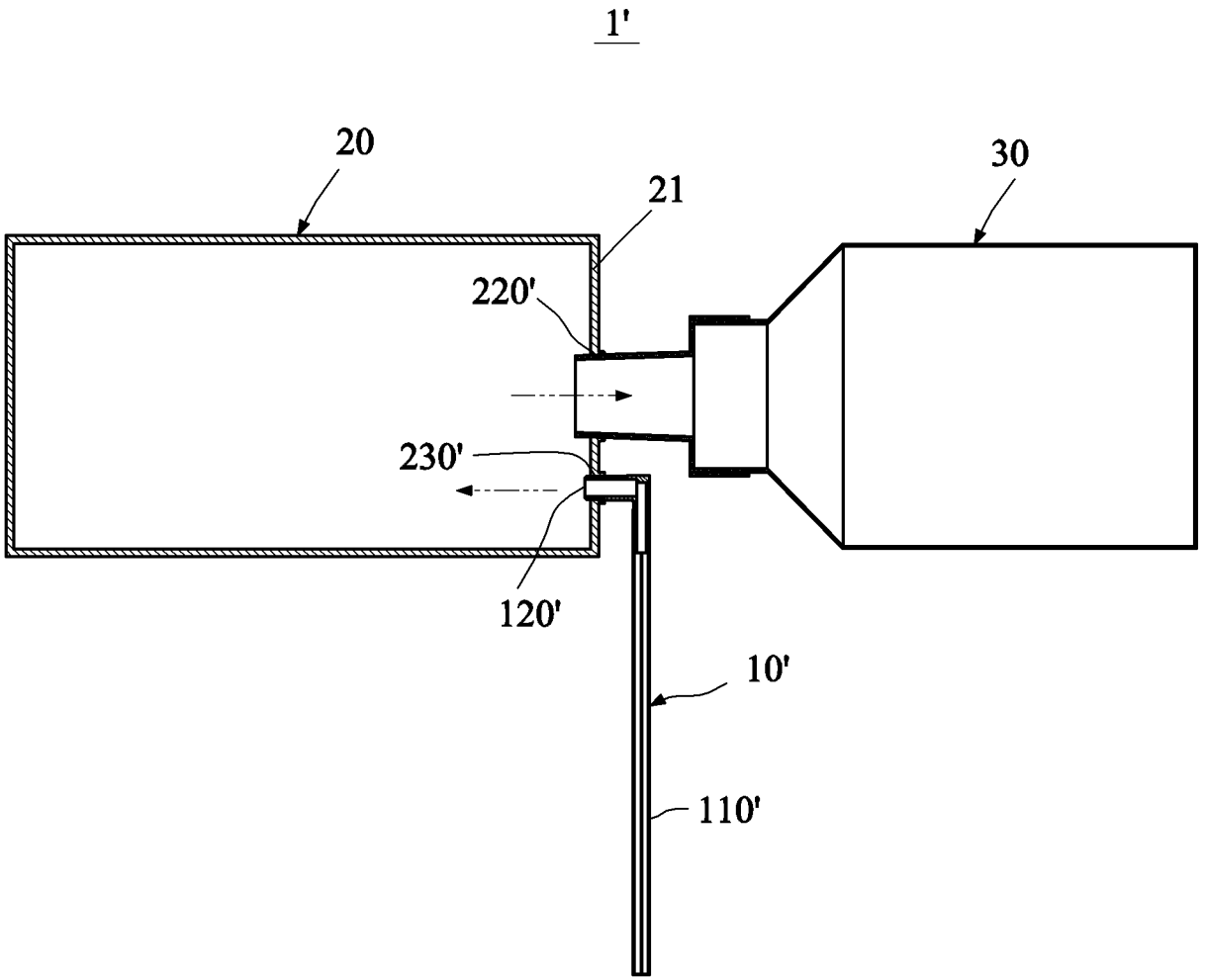
FIG. 3D is a schematic view showing the rechargeable toner cartridge assembly after being used according to another embodiment of this disclosure.

FIGS. 3A to 3B are schematic views showing steps of using the rechargeable toner cartridge assembly 1' according to another embodiment of this disclosure, and are respectively a schematic exploded view showing the rechargeable toner cartridge assembly 1' before being used, an assembled cross-sectional view showing the rechargeable toner cartridge assembly 1' upon being used, a schematic view showing air flow directions upon being used, and a schematic view showing the rechargeable toner cartridge assembly 1' after being used. Referring to FIGS. 3A to 3D, the toner cartridge 20 includes a toner refilling hole 220' and a first connection portion 230', both of which are disposed on one end of the toner cartridge 20, and penetrate through the housing 21 of the toner cartridge 20. The toner refilling bottle 30 contains the toner to be refilled into the toner cartridge 20 through the toner refilling hole 220'. The filter device 10' includes a body 110', a chamber and an intake hole 120'. The body is made of a flexible material, such as rubber, a balloon, a plastic bag or the like. The chamber is a space with a non-fixed volume formed inside the body 110' of the filter device 10'. In other words, the body 110' has a space with a retractable volume. The intake hole 120' is disposed on the body, to be connected to the first connection portion 230' of the toner cartridge 20 and can communicate with the chamber. When the air from the first connection portion 230' of the toner cartridge 20 enters the intake hole 120' of the filter device 10', the air overflowing from the first connection portion 230' enters the chamber together with the toner. The overflowing air is generated when the user is refilling the toner because the mouth of the toner refilling bottle 30 is inserted into the toner refilling hole 220' of the toner cartridge 20, so that the toner refilled into the toner cartridge pushes the air in the toner cartridge 20 and the toner refilling bottle 30 to flow toward the first connection portion 230'. At this time, the toner refilling bottle 30 is in a compressed state upon being used, so the toner and air in the toner refilling bottle 30 are pushed into the toner cartridge 20, and the excess air passing through the toner cartridge 20 enters the filter device 10' so that the filter device 10' is in an expansion state (the volume is enlarged, as shown in FIG. 3C). After the toner refilling bottle 30 recovers the original shape, the air in the toner cartridge 20 and the filter device 10' returns to the toner refilling bottle 30, and the filter device having the retractable volume space returns to the original flat state (or contraction state, as shown in FIG. 3D). That is, when the volume of the body 110' is reduced, the mixed gas returns to the toner refilling bottle 30 from the filter device 10' through the intake hole 120' and the first connection portion 230'. Thus, when the toner is being refilled, the toner cannot be dispersed into the outside atmosphere due to the overflowing mixed gas, and there is no adverse effect to the air pollution and the user's health.

Figure 4A:
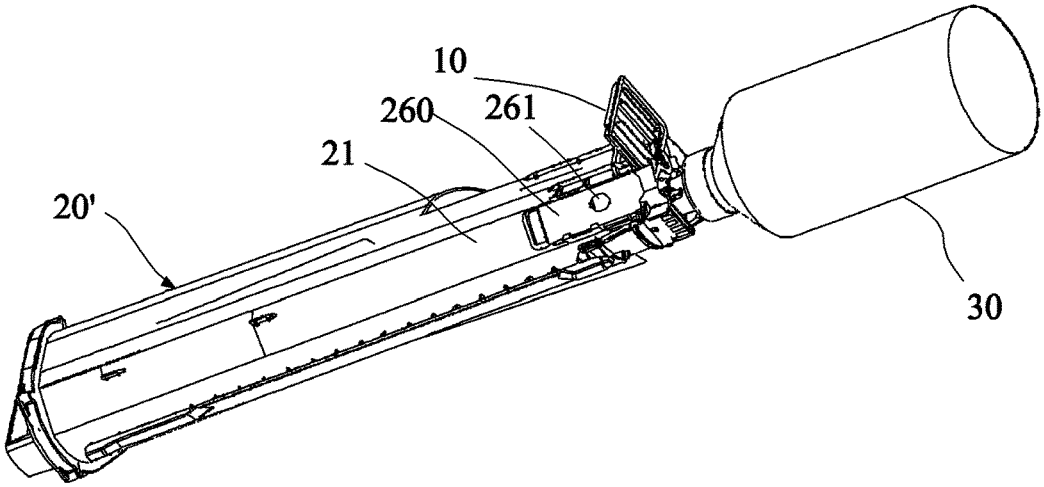
FIGS. 4A and 4B are pictorial views showing two states of a rechargeable toner cartridge assembly according to still another embodiment of this disclosure.
Figure 4B:
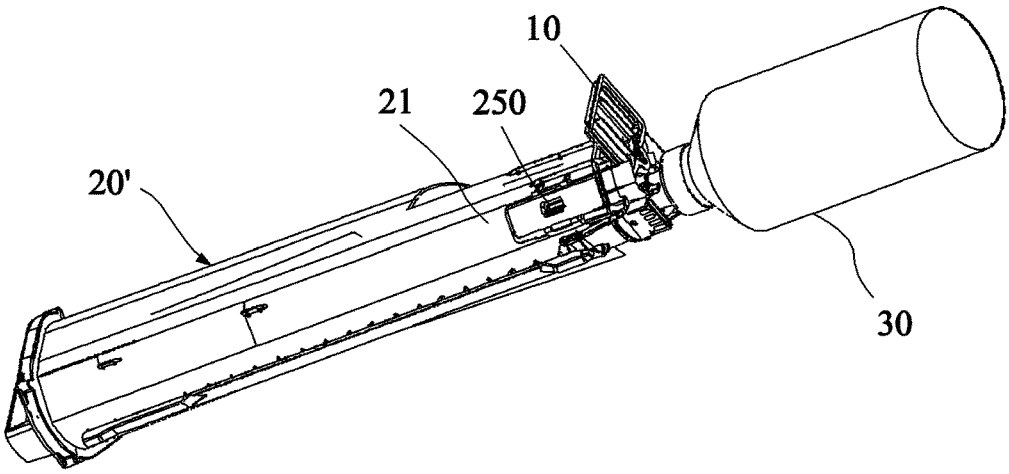

FIGS. 4A and 4B are pictorial views showing two states of the rechargeable toner cartridge assembly according to still another embodiment of this disclosure. Referring to FIGS. 4A and 4B, the rechargeable toner cartridge 20' further includes a toner outlet 250 and a gate 260 (the gate 260 has been removed from FIG. 4B for the purpose of clear illustration). The toner outlet 250 penetrates through the housing 21, and has the opening facing downwards upon actually working, so that the toner is outputted from the toner outlet 250 to another development device (not shown). The gate 260 has a gate hole 261, is slidably disposed on the housing 21, and controls the toner outlet 250 to open and close by aligning the gate hole 261 with the toner outlet 250 or not. In this embodiment, the toner outlet 250 and the toner refilling hole 220 are disposed on different side surfaces of the housing 21.

Figure 4C:
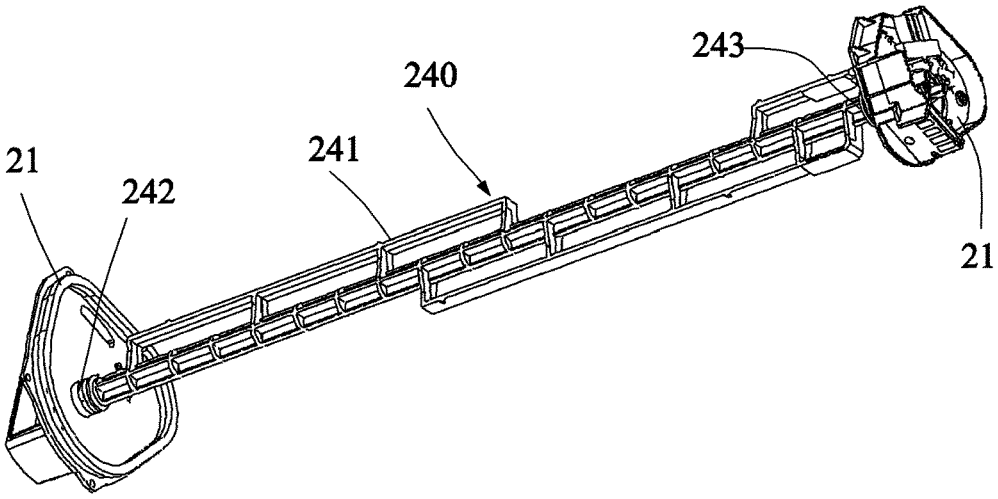
FIG. 4C is a pictorial view showing some elements in FIG. 4A.

FIG. 4C is a pictorial view showing some elements in FIG. 4A. Referring to FIG. 4C, the rechargeable toner cartridge further includes a stirrer 240 having a stirring structure 241 and two ends 242 and 243. The stirring structure 241 is rotatably connected to the housing 21 and connected to two ends 242 and 243 to stir the toner.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A rechargeable toner cartridge assembly, comprising:

a toner cartridge comprising a toner refilling hole and a connection portion, wherein both of the toner refilling hole and the connection portion are disposed on one end of the toner cartridge and penetrate through a housing of the toner cartridge;

a toner refilling bottle containing toner, wherein the toner is refilled into the toner cartridge through the toner refilling hole; and a filter device, which is connected to the connection portion and filters the toner off a mixed gas overflowing from the toner cartridge to discharge clean air, wherein the toner cartridge and the filter device are two independent devices.

2. The rechargeable toner cartridge assembly according to claim 1, wherein the filter device comprises:

a body;

a chamber disposed inside the body;

an intake hole disposed on the body, wherein the intake hole is connected to the connection portion of the toner cartridge and communicates with the chamber;

an outtake hole disposed on the body, so that the mixed gas entering the chamber from the intake hole can be filtered and then overflow from the outtake hole; and multiple baffle plates staggered and disposed in the chamber, wherein when the mixed gas enters the intake hole of the filter device from the connection portion of the toner cartridge, the mixed gas needs to pass through the baffle plates disposed in the chamber before being discharged from the outtake hole.

3. The rechargeable toner cartridge assembly according to claim 1, wherein the toner refilling hole and the connection portion are disposed on a same surface of the toner cartridge.

4. The rechargeable toner cartridge assembly according to claim 1, wherein the toner refilling hole and the connection portion are disposed on adjacent side surfaces of the toner cartridge.

5. A filter device, comprising:

a body;

a chamber disposed inside the body;

an intake hole, which is disposed on the body, is connected to a first connection portion of a toner cartridge and communicates with the chamber;

an outtake hole, which is disposed on one end or one side of the body corresponding to the intake hole and communicates with the chamber;

multiple baffle plates staggered and disposed in the chamber, wherein:

when a mixed gas enters the intake hole of the filter device from the first connection portion of the toner cartridge, the mixed gas needs to pass through the baffle plates disposed in the chamber before being discharged from the outtake hole; and a second connection portion disposed outside the intake hole of the body, wherein the second connection portion is docked with the first connection portion of the toner cartridge.

6. The filter device according to claim 5, wherein axial directions of the intake hole and the outtake hole are parallel to each other.

7. The filter device according to claim 5, wherein axial directions of the intake hole and the outtake hole are perpendicular to each other.

8. The filter device according to claim 5, further comprising a filter disposed at the intake hole, wherein the filter filters toner from the toner cartridge.

9. The filter device according to claim 5, further comprising a filter disposed at the outtake hole, wherein the filter filters toner from the chamber.

10. A filter device, comprising:

a body;

a chamber disposed inside the body;

an intake hole, which is disposed on the body, is connected to a connection portion of a toner cartridge and communicates with the chamber;

an outtake hole, which is disposed on one end or one side of the body corresponding to the intake hole and communicates with the chamber; and multiple baffle plates staggered and disposed in the chamber, wherein:

when a mixed gas enters the intake hole of the filter device from the connection portion of the toner cartridge, the mixed gas needs to pass through the baffle plates disposed in the chamber before being discharged from the outtake hole;

wherein the body is flexible to change between an expansion state and a contraction state.

11. A rechargeable toner cartridge assembly, comprising:

the filter device according to claim 10, wherein the filter device filters toner off the mixed gas overflowing from the toner cartridge;

the toner cartridge comprising a toner refilling hole and the connection portion, wherein both of the toner refilling hole and the connection portion are disposed on one end of the toner cartridge, and penetrate through a housing of the toner cartridge; and a toner refilling bottle containing the toner, wherein the toner is refilled into the toner cartridge through the toner refilling hole;

wherein when the mixed gas enters the intake hole of the filter device from the connection portion of the toner cartridge, a volume of the body of the filter device is enlarged.

12. The rechargeable toner cartridge assembly according to claim 11, wherein when the volume of the body is reduced, the mixed gas returns to the toner refilling bottle from the filter device through the intake hole and the connection portion.

13. A rechargeable toner cartridge, comprising:

a toner refilling hole being an opening used to refill toner; and a connection portion, wherein both of the connection portion and the toner refilling hole are disposed on one end of the toner cartridge, and penetrate through a housing of the toner cartridge;

wherein in the toner cartridge, an air flow path from the toner refilling hole to the connection portion is a direct path without passing through an air filter element, wherein the rechargeable toner cartridge without a built-in air filter element and a built-in inner air filter passage has a stirrer for stirring the toner in the rechargeable toner cartridge.

14. The rechargeable toner cartridge according to claim 13, wherein the stirrer has a stirring structure and two ends rotatably connected to the housing and connected to the stirring structure, wherein the stirring structure stirs the toner.

15. The rechargeable toner cartridge according to claim 13, further comprising: a toner outlet penetrating through the housing, so that the toner is outputted from the toner outlet; and a gate having a gate hole and being slidably disposed on the housing, wherein the toner outlet is controlled to open or close by aligning the gate hole with the toner outlet or not.

16. The rechargeable toner cartridge according to claim 15, wherein the toner outlet and the toner refilling hole are disposed on different side surfaces of the housing.

* * * * *